US010428698B2

(12) United States Patent
Altherr et al.

(10) Patent No.: US 10,428,698 B2
(45) **Date of Patent: *Oct. 1, 2019**

(54) VALVE DRIVE FOR AN INTERNAL COMBUSTION ENGINE

(71) Applicant: Mahle International GmbH, Stuttgart (DE)

(72) Inventors: Patrick Altherr, Stuttgart (DE); Thorsten Ihne, Stuttgart (DE); Markus Walch, Bretten (DE)

(73) Assignee: Mahle International GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/936,061

(22) Filed: Mar. 26, 2018

(65) Prior Publication Data

US 2018/0274396 A1 Sep. 27, 2018

(30) Foreign Application Priority Data

Mar. 27, 2017 (DE) ..... 10 2017 205 141

(51) Int. Cl.
*F01L 13/00* (2006.01)
*F01L 1/24* (2006.01)
(Continued)

(52) U.S. Cl.
CPC ..... *F01L 1/2416* (2013.01); *F01L 1/04* (2013.01); *F01L 1/047* (2013.01); *F01L 1/053* (2013.01);
(Continued)

(58) Field of Classification Search
CPC ... F01L 1/047; F01L 1/053; F01L 1/08; F01L 1/46; F01L 13/0005; F01L 13/0036
(Continued)

(56) References Cited

U.S. PATENT DOCUMENTS 7,493,878 B2 2/2009 Schon et al.
2010/0139594 A1* 6/2010 Wutzler ..... F01L 13/0036 123/90.17
(Continued)

FOREIGN PATENT DOCUMENTS

DE 19945340 A1 3/2001
DE 102004033963 A1 2/2006
(Continued)

OTHER PUBLICATIONS

English abstract for DE-102004033963.
English abstract for DE-19945340.
English abstract for DE-202015009047.

*Primary Examiner* — Jorge L Leon, Jr.
(74) *Attorney, Agent, or Firm* — Fishman Stewart PLLC

(57) ABSTRACT

A valve drive for an internal combustion engine may include a camshaft, at least one cam follower, at least one adjusting device, and at least one control shaft. The camshaft may include at least one cam group. The at least one cam group may include a first cam and a second cam. The at least one cam follower may be drive-connected to the first cam in a first position and to the second cam in a second position. The at least one adjusting device may include a first adjustable engagement element and a second adjustable engagement element. alternately adjustable between a basic position and a switching position. The at least one control shaft may include at least one control element group including a first control element and a second control element adjustable to a switching element position and to a basic element position.

20 Claims, 5 Drawing Sheets

Figure 1:
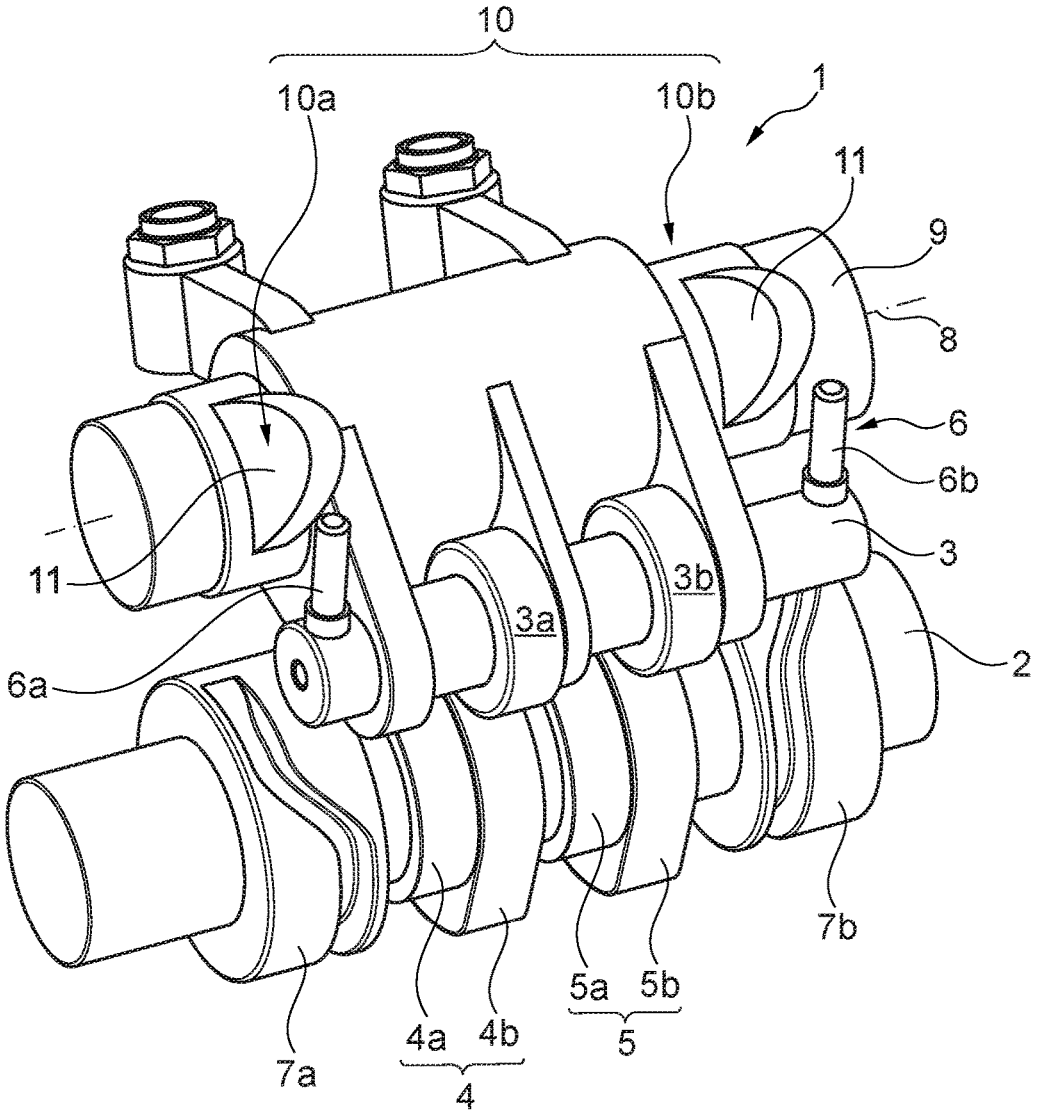

(51) Int. Cl.

| | |
|---|---|
| ***F01L 1/18*** | (2006.01) |
| ***F01L 1/047*** | (2006.01) |
| ***F01L 1/04*** | (2006.01) |
| ***F01L 1/053*** | (2006.01) |
| ***F01L 1/12*** | (2006.01) |
| *F01L 1/26* | (2006.01) |

(52) U.S. Cl.
CPC *F01L 1/12* (2013.01); *F01L 1/18* (2013.01); *F01L 1/181* (2013.01); *F01L 1/24* (2013.01); *F01L 1/267* (2013.01); *F01L 2013/001* (2013.01); *F01L 2013/105* (2013.01); *F01L 2105/00* (2013.01)

(58) Field of Classification Search
USPC ..... 123/90.16, 90.17, 90.21, 90.27
See application file for complete search history.

(56) References Cited

U.S. PATENT DOCUMENTS

| | | | | |
|---|---|---|---|---|
| 2011/0315103 | A1* | 12/2011 | Kim | F01L 1/053<br>123/90.16 |
| 2017/0198613 | A1* | 7/2017 | Raimondi | F01L 1/185 |
| 2017/0284238 | A1* | 10/2017 | Son | F01L 1/047 |
| 2017/0284314 | A1* | 10/2017 | Son | F01L 1/053 |

FOREIGN PATENT DOCUMENTS

| | | | |
|---|---|---|---|
| DE | 10312961 | C5 | 1/2009 |
| IE | 202015009047 | U1 | 8/2016 |

* cited by examiner

VALVE DRIVE FOR AN INTERNAL COMBUSTION ENGINE

CROSS-REFERENCE TO RELATED APPLICATIONS

This application claims priority to German Patent Application No. DE 10 2017 205 141.8, filed on Mar. 27, 2017, the contents of which are hereby incorporated by reference in its entirety.

TECHNICAL FIELD

The present invention relates to a valve drive for an internal combustion engine with a camshaft and with a cam follower.

BACKGROUND

Generic valve drives for an internal combustion engine with a camshaft and with at least one cam follower and with a cam group non-rotatably fixed on the camshaft with a first cam and with a second cam axially adjacent to the first cam are already known. There, the cam follower is drive-connected in a first position with the first cam of the respective cam group and in a second position with the second cam of the respective cam group. By way of an adjusting device, the cam follower can be switched between the first position and the second position and thus activate or deactivate a corresponding cylinder of the internal combustion engine. In order to control the adjusting device, the valve drive known from the prior art comprises a control shaft which is rotatably and axially moveably mounted and controls the adjusting device by way of a control element group fixed to the control shaft.

Disadvantageous with the control shaft known from the prior art however is that activating the adjusting device is only possible by a complex movement sequence—for example a rotation combined with an axial shift. This not only results in comparatively longer activation times but also increases the production and repair costs. Furthermore, a separate activation of the individual cylinders cannot be realised or only with major effort.

SUMMARY

The object of the invention therefore is to state for a valve drive of the generic type an alternative embodiment in which the activation of the individual cylinders is realised through a simplified movement sequence and a separate activation of the individual cylinders with a reduced effort is possible.

According to the invention, this object is solved through the subject of the independent claim(s). Advantageous embodiments are subject of the dependent claim(s).

The present invention is based on the general idea of stating a control shaft of a valve drive, with which the activation of the individual cylinders is realised through a simplified movement sequence for the first time and a separate activation of the individual cylinders with a reduced effort becomes possible. To this end, the valve drive comprises a camshaft and at least one cam follower, wherein the camshaft comprises at least one cam group that is non-rotatably fixed to the camshaft with a first cam and with a second cam that is axially adjacent to the first cam. In a first position, the respective cam follower is drive-connected with the first cam of the respective cam group and in a second position with the second cam of the respective cam group. For adjusting the cam follower in the first position or in the second position, the valve drive comprises at least one adjusting device which comprises a first adjustable engagement element and a second adjustable engagement element. Here, the first engagement element interacts with a first slotted guide arranged in the camshaft and the second engagement element interacts with a second slotted guide arranged on the camshaft. The first engagement element and the second engagement element are alternately adjustable between a basic position and a switching position, wherein in the basic position there is no contact with the associated slotted guide and in the switching position the respective engagement element interacts with the associated slotted guide. The valve drive also comprises at least one control shaft with at least one control element group, wherein the control element group comprises a first control element arranged on the control shaft and a second control element arranged on the control shaft. According to the invention, the control shaft is non-rotatably mounted and the first control element and the second control element can be brought into a switching element position and into a basic element position relative to the control shaft. In the switching element position, the corresponding engagement element is adjusted through a stop region of the control element from the basic position into the switching position and in the basic element position the control element does not have any contact with the corresponding engagement element.

According to the invention, the first control elements and the second control elements of the control shaft can be actuated independently of one another so that in this way the engagement elements can also be adjusted in any order. Consequently, the corresponding cylinders can be activated and deactivated in any order and the activation order can differ from the deactivation order. Furthermore, the activation orders and the deactivation orders can also differ in individual operating cycles. In this way, an advantageous flexible activation of the valve drive is achieved and the individual cylinders can be activated or deactivated individually, by pairs or one after the other. The movement sequence during the activation of the individual cylinders is also simplified so that the activation times and the production and the repair costs of the valve drive can be reduced.

In an advantageous further development of the solution according to the invention it is provided that the control element is a control cam. The control cam can tilt relative to the non-rotatably fixed control shaft and with the stop region adjust the corresponding engagement element.

It is provided that the control shaft comprises an inner shaft and an outer shaft encasing the inner shaft in regions, wherein the inner shaft is fixed in the non-rotatable outer shaft radially spaced from the same by a radially projecting stop element. Between the outer shaft and the inner shaft a lever space is thus formed in which the control cam with a lever element is arranged. The lever element in this case is arranged in the lever space partly rotatably between the outer shaft and the inner shaft lying against these and encasing the inner shaft in regions. In the switching element position, the lever element lies against the stop element of the inner shaft with a first lateral face and in the basic element position the lever element lies against the stop element of the inner shaft on the other side with a second lateral face.

The stop region of the control element is fixed to the lever element and radially projects out of a tilting aperture of the outer shaft. When the lever element is rotated out of the basic element position on the inner shaft, the second lateral face of the lever element moves away from the stop element of the inner shaft and the first lateral face of the lever element approaches the stop element on the other side. The stop region fixed to the lever element tilts relative to the non-rotatable control shaft and changes from the basic element position into the switching element position. When the first lateral face lies against the stop element of the inner shaft, the switching element position has been reached. The movement of the stop region in this case is additionally delimited by the size of the tilting aperture on the outer shaft.

For adjusting the control cam it is advantageously provided that the lever element and the stop element of the inner shaft in the basic element position comprise a first pressure space between the first lateral face and the stop element and in the switching element position a second pressure space between the second lateral face and the stop element. Here, the first pressure space and the second pressure space are each part of the lever space and are arranged on both sides of the stop element of the inner shaft and separated by the same. Between the first pressure space and the second pressure space an additional seal—for example on the lever element—can be provided. In order to be able to control the control cam, the control cam comprises a control arrangement by way of which the pressure in the first pressure space of the control cam and/or in the second pressure space of the control cam—can be changed—for example hydraulically.

When the pressure in the second pressure space is now higher than in the first pressure space, the lever element rotates on the inner shaft from the basic element position until the pressure in the first pressure space and in the second pressure space is equalised. The stop region fixed to the lever element rotates relative to the control shaft into the switching element position and can adjust the engagement element. In order to adjust the control cam into the basic element position, the pressure in the first pressure space can be increased and in the second pressure space reduced so that the lever element equalises the pressure in the first pressure space and in the second pressure space by a rotation and adjusts back into the basic element position.

Advantageously, a resetting arrangement can be provided on the control cam which facilitates resetting the control cam into the basic element position. The resetting arrangement can for example be a spring resetting arrangement with a torsion spring, a coil spring or a bending spring. In the case of the spring resetting arrangement with a coil spring, the same can be arranged in the first pressure space between the stop element and the first lateral face of the lever element and secure a resetting of the control cam into the basic element position. Alternatively, the coil spring can also be fixed to the stop region of the control cam outside the control shaft or to a directional control valve of a hydraulic control arrangement.

In an alternative further development of the valve drive according to the invention it is advantageously provided that the control element is an adjusting rod. The adjusting rod can radially shift relative to the non-rotatable control shaft and thus adjust the corresponding engagement element.

Advantageously it is provided that the control shaft comprises a radial adjusting bore with a first stop face and with a second stop face and that in the adjusting bore the adjusting rod is arranged in regions. The adjusting rod in this case is fixed axially shiftably by a radial boundary edge in the adjusting bore, wherein a stop region of the adjusting rod projects from the adjusting bore on one side. By axially shifting the adjusting rod in the adjusting bore, the adjusting rod can now be adjusted through the switching element position and the basic element position.

In the basic element position, the boundary rod with the boundary edge lies against the second stop face of the adjusting bore. The stop region of the adjusting rod is arranged in the adjusting bore at least in regions so that the adjusting rod has no contact with the corresponding engagement element. When the adjusting rod is moved out of the control shaft, the boundary edge moves away from the second stop face of the adjusting bore and on the other side approaches the first stop face of the adjusting bore. The stop region moves with the boundary rod out of the control shaft radially to the outside and can adjust the engagement element. As soon as the boundary edge lies against the first stop face of the adjusting bore, the switching element position has been reached.

For adjusting the adjusting rod it is advantageously provided that in the basic element position the boundary edge of the adjusting rod and the first stop face comprise a first pressure space and in the switching element position the boundary edge of the adjusting rod and the second stop face comprise a second pressure space. Between the first pressure space and the second pressure space a seal—for example on the boundary edge of the adjusting rod—can be provided. A control arrangement can—for example hydraulically—change the pressure in the first pressure space of the adjusting rod and/or in the second pressure space of the adjusting rod so that the adjusting rod can change between the switching element position and the basic element position.

In the basic element position, the adjusting rod with the boundary edge lies against the second stop face of the adjusting bore. When the pressure in the second pressure space is increased relative to the first pressure space the pressure in the first pressure space and in the second pressure space is equalised by a shifting of the adjusting rod and the adjusting rod changes from the basic element position to the switching element position. When, in the switching element position, the pressure in the first pressure space is increased relative to the second pressure space, the adjusting rod changes back into the basic element position.

Advantageously, a resetting arrangement can be provided on the adjusting rod, which resetting arrangement facilitates resetting the adjusting rod into the basic element position. The resetting arrangement can for example be a spring resetting arrangement with a torsion spring, a coil spring or a bending spring. In the case of the spring resetting arrangement with a coil spring, the same can be arranged in the first pressure space between the first stop face and the boundary edge about the stop region of the adjusting rod. The adjustment of the adjusting rod from the basic element position into the switching element position can take place through the pressure change in the second pressure space and the resetting of the adjusting rod into the basic element position supported by the spring resetting arrangement.

In an alternative further embodiment of the valve drive according to the invention it is advantageously provided that the control element is a rotary lever. The rotary lever can rotate on the control shaft relative to the same about a defined angle of rotation, so that the respective engagement element can be adjusted.

Advantageously it is provided that the control shaft comprises a longitudinal groove radially circulating about the control shaft in regions and the rotary lever comprises a circumferential region encasing the control shaft on the longitudinal groove. A connecting pin projects through a radial through-bore in the circumferential region into the longitudinal groove of the control shaft and rotatably connects the rotary lever with the control shaft. By way of a movement of the connecting pin along the longitudinal groove, the rotary lever on the control shaft can be rotated and adjusted between the switching element position and the basic element position.

Advantageously it is provided that in the basic element position the connecting pin of the rotary lever and a first lateral face of the longitudinal groove comprise a first pressure space and in the switching element position the connecting pin of the rotary lever and a second lateral face of the longitudinal groove comprise a second pressure space. Through a control arrangement, the pressure in the first pressure space of the rotary lever and/or in the second pressure space of the rotary lever can be changed—for example hydraulically—so that the rotary lever can change between the switching element position and the basic element position. Between the first pressure space and the second pressure space a seal—for example on the connecting pin—can be provided. The shape of the connecting pin can also be adapted for a better sealing of the two pressure spaces.

In the basic element position, the connecting pin lies against the second stop face of the longitudinal groove. When the pressure in the second pressure space is increased compared with the first pressure space, the pressure in the first pressure space and in the second pressure space is equalised by a shifting of the connecting pin in the longitudinal groove and the adjusting rod changes from the basic element position into the switching element position. When in the switching element position the pressure in the first pressure space is increased compared with the second pressure space the connecting pin changes back into the basic element position.

Advantageously, a resetting arrangement can be provided on the rotary lever which facilitates resetting the rotary lever into the basic element position. The resetting arrangement can for example be a spring resetting arrangement with a torsion spring, a coil spring or a bending spring. In the case of the spring resetting arrangement with a coil spring, the same can be arranged for example in the first pressure space between the first stop face and the connecting pin. The adjustment of the rotary lever from the basic element position into the switching element position can take place through the pressure change in the second pressure space and the resetting of the rotary lever into the basic element position be achieved through the resetting arrangement.

In a particularly advantageous further development of the solution according to the invention it is provided that the control shaft is a rocker lever shaft. Accordingly, the control shaft can be combined with the rocker lever shaft and the installation space for the valve drive reduced.

Advantageously it is provided, furthermore, that the control arrangement is hydraulic and that a directional control valve of the control arrangement is adjustable into a blocking rest position. When the directional control valve of the control arrangement is brought into the blocking rest position, the control element is in the basic element position. By means of the hydraulic control arrangement, the control element can be brought from the switching element position back into the basic element position in a simple energy-saving manner.

Further important features and advantages of the invention are obtained from the subclaims, from the drawings and from the associated figure description by way of the drawings.

It is to be understood that the features mentioned above and still to be explained in the following cannot only be used in the stated combination but also in other combinations or by themselves without leave the scope of the present invention.

Preferred further exemplary embodiments of the invention are shown in the drawings and are explained in more detail in the following description, wherein same reference characters relate to same or similar or functionally same components.

DETAILED DESCRIPTION OF THE DRAWINGS

It shows, in each case schematically

Figure 2:
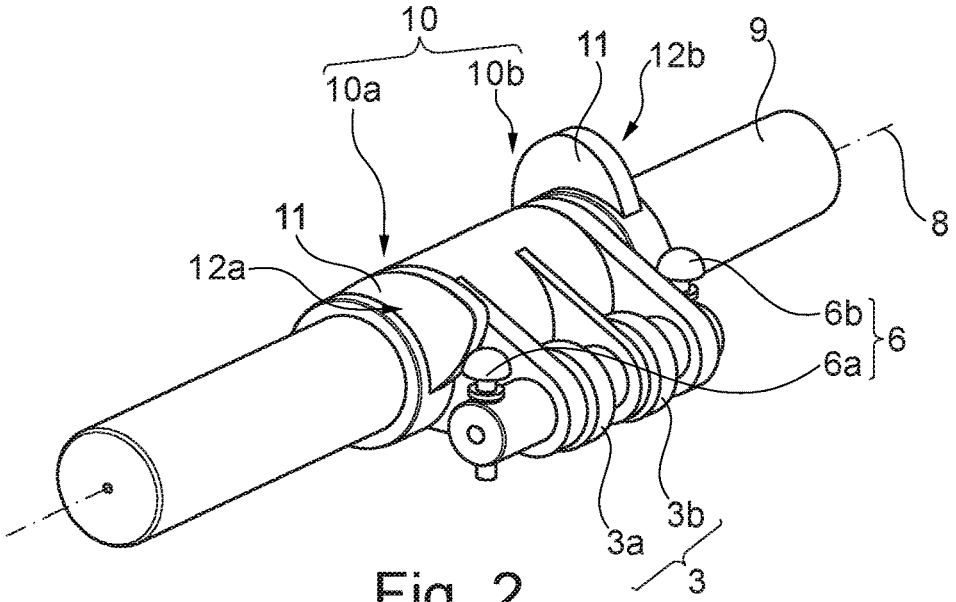
Figure 3:
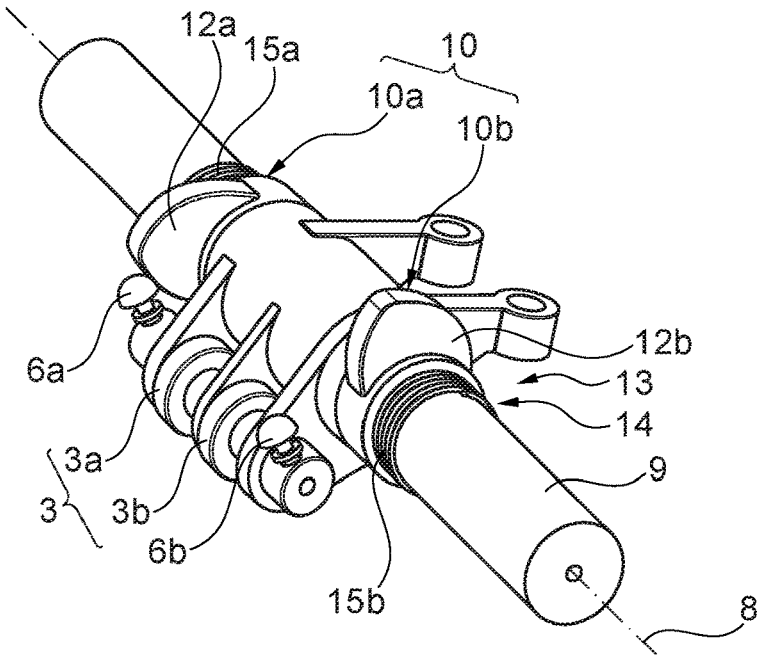
Figure 4:
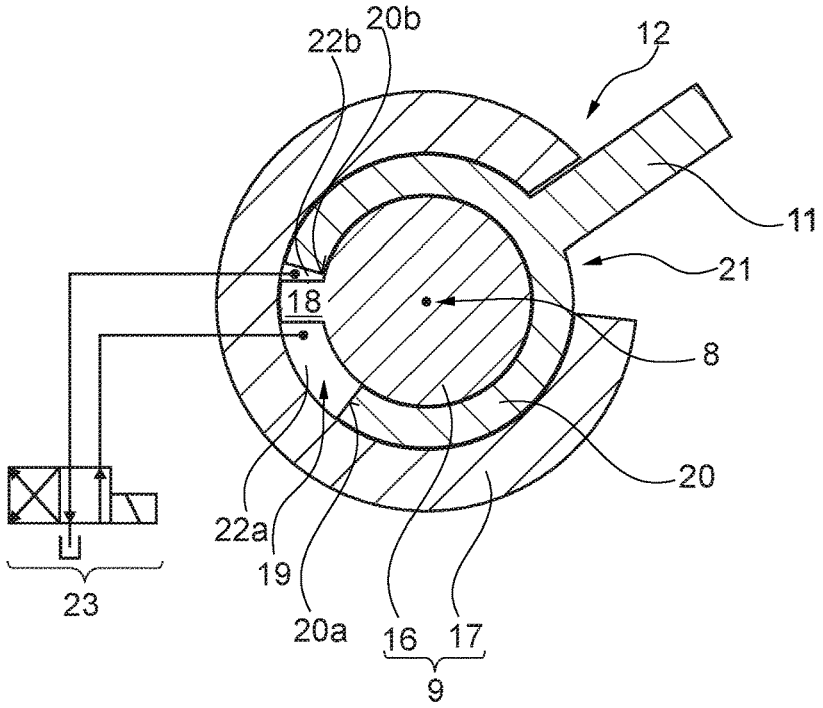
Figure 5:
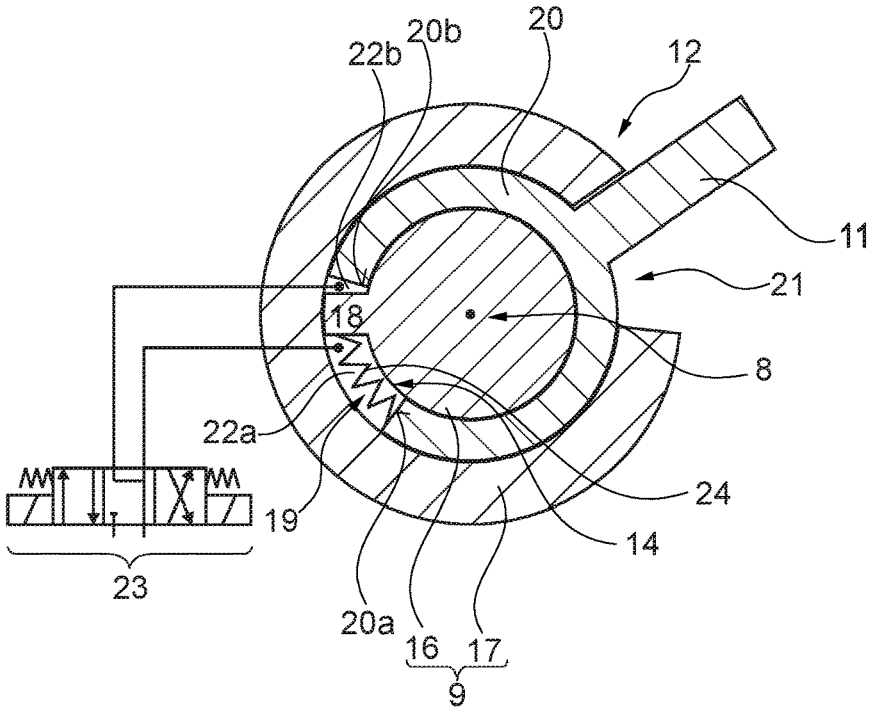
Figure 6:
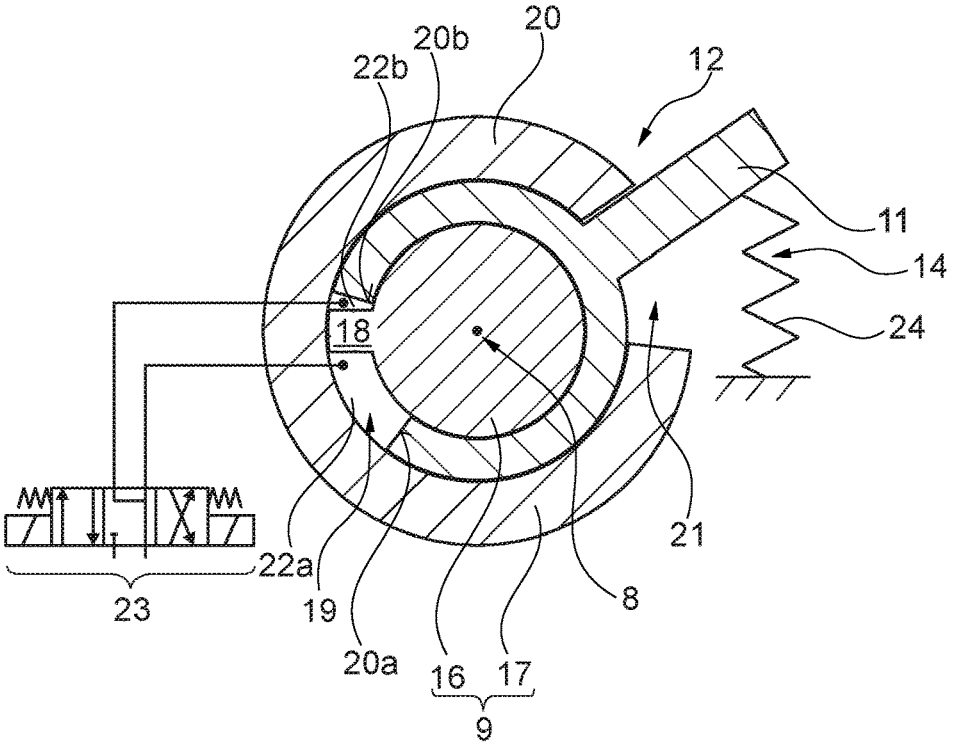
Figure 7:
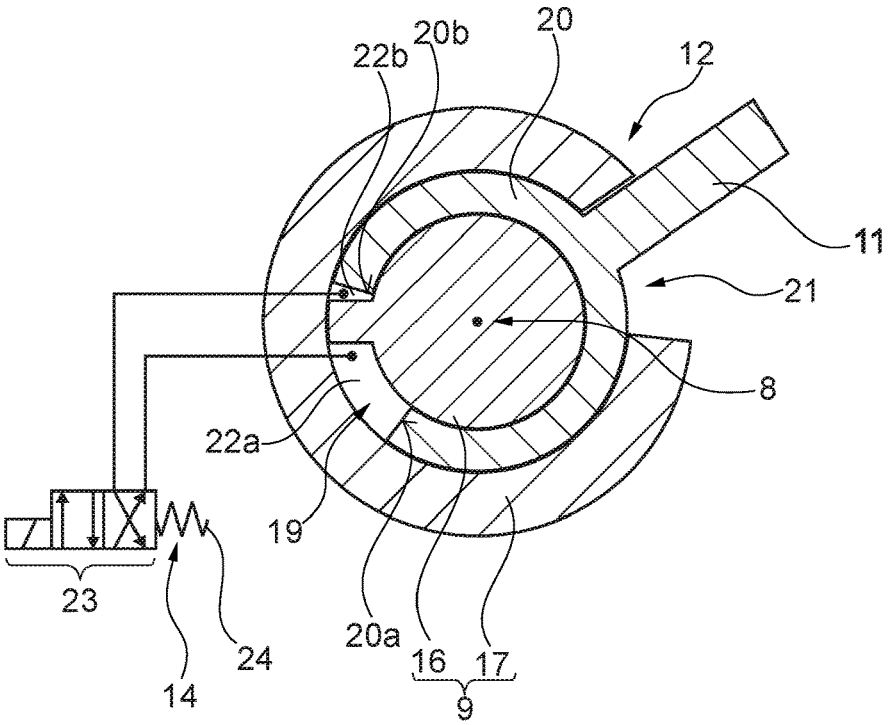
Figure 8:
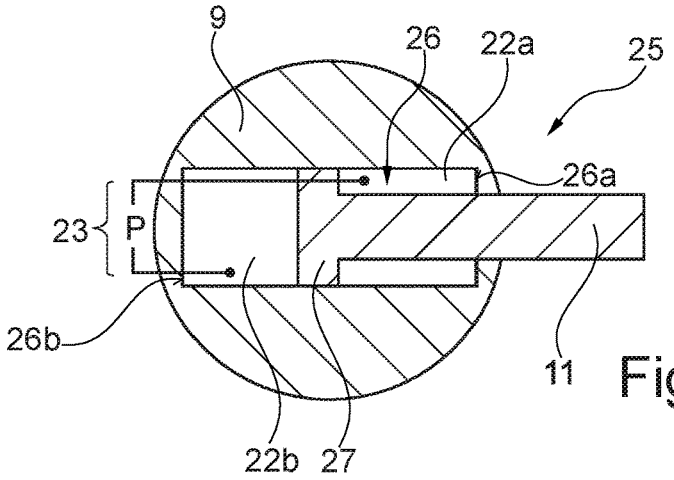
Figure 9:
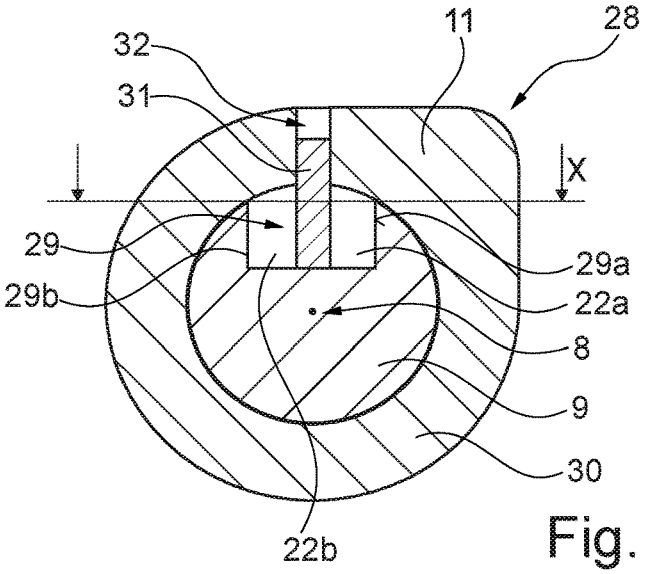
Figure 10:
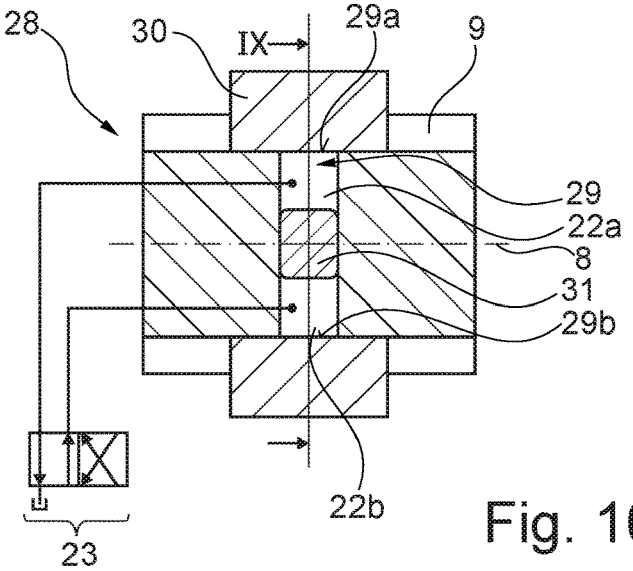

FIG. 1 a part view of a valve drive with a control shaft;

FIG. 2 a view of a control element group with a first control element and with a second control element in the form of a control cam;

FIG. 3 a view of the control element group shown in FIG. 2 with a spring resetting arrangement with a torsion spring;

FIG. 4 a sectional view of a control element in the form of a control cam;

FIG. 5 a sectional view of the control element shown in FIG. 3 in the form of a control cam with a spring resetting arrangement located inside;

FIG. 6 a sectional view of the control element shown in FIG. 3 in the form of a control element with a spring resetting arrangement located outside;

FIG. 7 a sectional view of the control element shown in FIG. 3 in the form of a control cam with a spring resetting arrangement on a directional control valve;

FIG. 8 a sectional view of a control element in the form or an adjusting rod;

FIG. 9 a sectional view of a control element in the form of a rotary lever;

FIG. 10 a part sectional view of the control element shown in FIG. 9 in the form of a rotary lever.

DETAILED DESCRIPTION

FIG. 1 shows a part view of a valve drive 1 of an internal combustion engine which is not shown in more detail. The valve drive 1 comprises a camshaft 2 and a cam follower 3. The camshaft 2 comprises a first cam group 4 with a first cam 4*a* and with a second cam 4*b* as well as a second cam group 5 with a first cam 5*a* and with a second cam 5*b*. The first cam group 4 and the second cam group 5 are non-rotatably fixed on the camshaft 2. By way of the first cam group 4 and the second cam group 5, a corresponding cylinder which is not shown in more detail can be activated in that for example the first cam group 4 activates an inlet valve of the cylinder and the second cam group 5 an exhaust valve of the cylinder.

The cam follower 3 is drive-connected via a first roller 3*a* with the first cam group 4 and via a second roller 3*b* with the second cam group 5. In a first position, the rollers 3*a* and 3*b* interact with the first cams 4*a* and 5*a* of the respective cam groups 4 and 5 and in a second position the rollers 3*a* and 3*b* act with the second cams 4*b* and 5*b* of the respective cam groups 4 and 5.

For adjusting the cam follower 3 into the first position or into the second position, the valve drive 1 comprises an adjusting device 6 which comprises a first adjustable engagement element 6*a* and a second adjustable engagement element 6*b*. The first engagement element 6*a* interacts with a first slotted guide 7*a* arranged on the camshaft 2 and the second engagement element 6*b* interacts with a second slotted guide 7*b* arranged on the camshaft 2. The first engagement element 6*a* and the second engagement element

6*b* are alternately adjustable between a basic position and a switching position, wherein in the basic position there is no contact with the associated slotted guide 7*a* or 7*b* and in the switching position the respective engagement element 6*a* or 6*b* interacts with the associated slotted guide 7*a* or 7*b*.

The valve drive 1 also comprises a non-rotatable control shaft 9 which is rotation-symmetrical about a longitudinal axis 8 with a control element group 10, wherein the control element group 10 comprises a first control element 10*a* that is rotatable on the control shaft 9 and a second control element 10*b* that is rotatable on the control shaft 9. In this exemplary embodiment, the control shaft 9 and a rocker lever shaft of the valve drive 1 are combined. According to the invention, the first control element 10*a* comprises a stop region 11 for the first engagement element 6*a* and the second control element 10*b* likewise comprises the stop region 11 for the second engagement element 6*b*. Upon the rotation of the first control element 10*a* on the control shaft 9, the first engagement element 6*a* can be adjusted by the stop region 11 from the basic position into the switching position. Upon the rotation of the second control element 10*b* of the control shaft 9, the second engagement element 6*b* can be adjusted by the stop region 11 from the basic position into the switching position.

According to the invention the respective first control elements 10*a* and the respective second control elements 10*b* of the control shaft 9 can be actuated independently of one another. With multiple control elements 10*a*, 10*b* on a control shaft 9, the respective engagement elements 6*a* and 6*b* can thus be adjusted in any order and the corresponding cylinders can consequently be activated and deactivated in any order. Advantageously, the activation order can also differ from the deactivation order and the activation orders and the deactivation orders be different in individual operating cycles.

FIG. 2 shows a view of the control element group 10 with a first control element 10*a* and with a second control element 10*b*, both in the form of a control cam 12. The control cams 12*a* and 12*b* can be rotated independently of one another relative to the non-rotatable control shaft 9 and with the stop regions 11, adjust the engagement elements 6*a* and 6*b*. Accordingly, the first control cam 12*a* is rotated relative to the control shaft 9 in FIG. 2 and is in the switching element position in contact with the first engagement element 6*a*. The second control cam 12*b* is in the basic element position and has no contact with the second engagement element 6*b*.

In FIG. 3, a view of the control element group 10 shown in FIG. 2 is shown with a resetting arrangement 13 in the form of a spring resetting arrangement 14.

The spring resetting arrangement 14 comprises torsion spring 15*a* and 15*b*, which make possible resetting the first control cam 12*a* and the second control cam 12*b* into the basic element position. The torsion springs 15*a* and 15*b* are fixed to the non-rotatable control shaft 9 and to the first control cam 12*a* and to the second control cam 12*b* so that upon a rotation of the control cams 12*a* and 12*b* a resetting force through the spring force of the torsion spring 15*a* and 15*b* acts on the control cams 12*a* and 12*b* bringing these into the basic element position.

FIG. 4 shows a sectional view of the control elements 10*a* or 10*b* in the form of the control cam 12. The control shaft 9 comprises an inner shaft 16 and an outer shaft 17 encasing the inner shaft 16 in regions, wherein the inner shaft 16 is fixed in the non-rotatable outer shaft 17 through a radially projecting stop element 18. Between the outer element 17 and the inner shaft 16 a lever space 19 is formed in which the control cam 12 with a lever element 20 is arranged. The lever element 20 is rotatably arranged in the lever space 19. In the switching element position, the lever element 20 lies against the stop element 18 of the inner shaft 16 with a first lateral face 20*a* and in the basic element position the lever element 20 lies against the stop element 18 of the inner shaft 16 with a second lateral face 20*b*. The stop region 11 of the control cam 12 is fixed to the lever element 20 and radially projects through a tilting aperture 21 of the outer shaft 17.

The lever element 20 and the stop element 18 of the inner shaft 16 form a first pressure space 22*a* between the first lateral face 20*a* and the stop element 18 and a second pressure space 22*b* between the second lateral face 20*b* and the stop element 18. Here, the first pressure space 22*a* and the second pressure space 22*b* are a part of the lever space 19 and are arranged on both sides of the stop element 18 of the inner shaft 16. By way of a control arrangement 23, the pressure in the first pressure space 22*a* and/or in the second pressure space 22*b* can be changed—for example hydraulically—so that the lever element 20 of the inner shaft 16 is rotated. Consequently, the stop region 11 also rotates relative to the non-rotatable control shaft 9 and adjusts the corresponding engagement element 6*a* or 6*b*.

In FIG. 5, in FIG. 6 and in FIG. 7, sectional views of the control cam 12 shown in FIG. 3 with the spring resetting arrangement 14 are shown, which comprises a coil spring 24. In FIG. 5, the coil spring 24 is arranged located inside between the stop element 18 and the first lateral face 20*a* of the lever element 20; in FIG. 6, the coil spring 24 is arranged located outside on the stop region 11 of the control cam 12 and in FIG. 7 the coil spring is arranged on a directional control valve of the hydraulic control arrangement 23. By way of the spring resetting arrangement 14, the control cam 12 can be brought back from the switching element position into the basic element position in a simple energy-saving manner.

FIG. 8 shows a sectional view of the control element 10*a* or 10*b* in the form of an adjusting rod 25. The control shaft 9 in this case comprises a radial adjusting bore 26 with a first stop face 26*a* and with a second stop face 26*b*. In the adjusting bore 26 the adjusting rod 25 is arranged in regions and axially shiftable by a radial boundary edge 27. The stop region 11 of the adjusting rod 25 projects from the adjusting bore 26 on one side, so that through an axial shifting of the adjusting rod 25 in the adjusting bore 26 the adjusting rod 25 can change between the switching element position and the basic element position.

The boundary edge 27 of the adjusting rod 25 and the first stop face 26*a* form the first pressure space 22*a* and the boundary edge 27 of the adjusting rod 25 and the second stop face 26*b* form the second pressure space 22*b*. The control arrangement 23 can change—for example hydraulically—the pressure in the first pressure space 22*a* and/or in the second pressure space 22*b* so that the adjusting rod 25 can change between the switching element position and the basic element position.

FIG. 9 shows a sectional view of the control element 10*a* or 10*b* in the form of a rotary lever 28 and FIG. 10 shows a part sectional view of the rotary lever 28 shown in FIG. 9. The control shaft 9 in this case comprises a longitudinal groove 29 radially circulating about the control shaft 9 in regions and the rotary lever 28 a circumferential region 30 encasing the control shaft 9 on the longitudinal groove. A connecting pin 31 projects through a radial through-bore 32 in the circumferential region 30 into the longitudinal groove 29 of the control shaft 9 and rotatably connects the rotary lever 28 with the control shaft 9. By way of a movement of the connecting pin 31 along the longitudinal groove 29, the rotary lever 28 can be rotated on the control shaft 9 and change between the switching element position and the basic element position.

The connecting pin 31 of the rotary lever 28 forms the first pressure space 22*a* with a first lateral face 29*a* of the longitudinal groove 29 and the second pressure space 22*b* with a second lateral face 29*b* of the longitudinal groove 29. Through a control arrangement 23, the pressure in the first pressure space 22*a* of the rotary lever 28 and/or in the second pressure space 22*b* of the rotary lever 28 can be changed—for example hydraulically—so that the rotary lever 28 can change between the switching element position and the basic element position.

The invention claimed is:

1. A valve drive for an internal combustion engine, the valve drive comprising:

a camshaft and at least one cam follower;

the camshaft including at least one cam group non-rotatably fixed on the camshaft, the at least one cam group including a first cam and a second cam disposed axially adjacent to the first cam;

the at least one cam follower being drive-connected to the first cam of the at least one cam group in a first position and to the second cam of the at least one cam group in a second position;

at least one adjusting device including a first adjustable engagement element and a second adjustable engagement element;

the first engagement element comprising a pin interacting with a first slotted guide arranged on the camshaft and the second engagement element comprising a pin interacting with a second slotted guide arranged on the camshaft;

wherein the first engagement element and the second engagement element are alternately adjustable between a basic position and a switching position;

wherein, when in the basic position, the first engagement element and the second engagement element do not contact the first slotted guide and the second slotted guide, respectively, and, when in the switching position, the first engagement element and the second engagement element interact with the first slotted guide and the second slotted guide, respectively;

at least one control shaft including at least one control element group, the at least one control element group including a first control element arranged on the at least one control shaft and a second control element arranged on the at least one control shaft, the first control element and the second control element each having a radially outwardly projecting stop region, wherein the first control element and the second control element are adjustable, relative to the at least one control shaft, to a switching element position and to a basic element position; and wherein in the switching element position the first engagement element and the second engagement element are adjusted from the basic position to the switching position via the stop region of a respective one of the first control element and the second control element, and wherein in the basic element position the respective one of the first control element and the second control element does not contact the first engagement element and the second engagement element, respectively.

2. The valve drive according to claim 1, wherein at least one of the first control element and the second control element is a control cam.

3. The valve drive according to claim 2, wherein:

the at least one control shaft further includes an inner shaft and an outer shaft radially encasing the inner shaft in at least some regions, the inner shaft fixed within and radially spaced apart from the outer shaft via a radially projecting stop element that defines a lever space between the outer shaft and the inner shaft; and the control cam includes a lever element arranged in the lever space partly rotatably between and lying against the outer shaft and the inner shaft, the lever element encasing the inner shaft in at least some regions, and wherein a first lateral face of the lever element lies against the stop element in the switching element position and a second lateral face of the switching element lies against the stop element in the basic element position.

4. The valve drive according to claim 3, wherein:

the lever element and the stop element delimit a first pressure space between the first lateral face and the stop element in the basic element position and a second pressure space between the second lateral face and the stop element in the switching element position, and wherein the lever space has the first pressure space and the second pressure space; and the control cam further includes a control valve arrangement structured and arranged to change a pressure in at least one of the first pressure space and the second pressure space such that the lever element adjusts between the switching element position and the basic element position.

5. The valve drive according to claim 4, wherein the control valve arrangement is hydraulic and includes a directional control valve that is adjustable into a blocking rest position.

6. The valve drive according to claim 1, wherein at least one of the first control element and the second control element is an adjusting rod.

7. The valve drive according to claim 6, wherein:

the at least one control shaft further includes a radial adjusting bore having a first stop face and a second stop face;

the adjusting rod is arranged within regions of the adjusting bore and fixed in the adjusting bore such that the adjusting rod axially shifts via a radial boundary edge of the adjusting rod; and the adjusting rod including the stop region radially projecting from the adjusting bore on one side such that the adjusting rod adjusts between the switching element position and the basic element position via an axial shift of the adjusting rod in the adjusting bore.

8. The valve drive according to claim 7, wherein:

in the basic element position, the boundary edge of the adjusting rod and the first stop face define a first pressure space and, in the switching element position, the boundary edge of the adjusting rod and the second stop face define a second pressure space; and the adjusting rod further includes a control valve arrangement structured and arranged to change a pressure in at least one of the first pressure space and the second pressure space such that the adjusting rod adjusts between the switching element position and the basic element position.

9. The valve drive according to claim 8, wherein the control valve arrangement is hydraulic and includes a directional control valve that is adjustable into a blocking rest position.

10. The valve drive according to claim 1, wherein at least one of the first control element and the second control element is a rotary lever.

11. The valve drive according to claim 10, wherein:

the at least one control shaft further includes a longitudinal groove radially circulating about the at least one control shaft in at least some regions; and the rotary lever includes a circumferential region encasing the at least one control shaft on the longitudinal groove, and wherein the rotary lever further includes a connecting pin projecting through a through-bore in the circumferential region and into the longitudinal groove of the at least one control shaft, the connecting pin tiltably connecting the rotary lever with the at least one control shaft such that the rotary lever adjusts between the switching element position and the basic element position via an adjustment of the connecting pin in the longitudinal groove.

12. The valve drive according to claim 11, wherein:

in the basic element position, the connecting pin and a first lateral face of the longitudinal groove define a first pressure space and, in the switching element position, the connecting pin and a second lateral face of the longitudinal groove define a second pressure space; and the rotary lever further includes a control valve arrangement structured and arranged to change a pressure in at least one of the first pressure space and the second pressure space such that the rotary lever adjusts between the switching element position and the basic element position.

13. The valve drive according to claim 1, wherein the at least one control shaft for at least one of the first control element and the second control element includes a spring resetting arrangement.

14. The valve drive according to claim 13, wherein the spring resetting arrangement includes at least one of a torsion spring, a coil spring, and a bending spring.

15. The valve drive according to claim 1, wherein the at least one control shaft is a rocker lever shaft.

16. The valve drive according to claim 1, wherein the first engagement element and the second engagement element are structured and arranged to extend radially relative to the camshaft.

17. The valve drive according to claim 1, wherein:

the at least one control shaft is a rocker lever shaft including an inner shaft and an outer shaft at least partially encasing the inner shaft, the inner shaft arranged within and radially spaced apart from the outer shaft via a stop element projecting radially therefrom, the inner shaft and the outer shaft defining a lever space therebetween; and at least one of the first control element and the second control element is a control cam, the control cam including a lever element at least partially arranged within the lever space, the lever element at least partially encasing the inner shaft and rotatable about the inner shaft such that a first lateral face of the lever element abuts the stop element when the lever element is in the switching element position and a second lateral face of the lever element abuts the stop element when the lever element is in the basic element position.

18. The valve drive according to claim 1, wherein:

the at least one control shaft further includes a radial adjusting bore having a first stop face and a second stop face; and at least one of the first control element and the second control element is an adjusting rod having a radial boundary edge, the adjusting rod arranged at least partially within the adjusting bore such that the adjusting rod axially shifts via the boundary edge, the adjusting rod including the stop region projecting on one side such that the adjusting rod is adjustable between the switching element position and the basic element position via an axial shift of the adjusting rod within the adjusting bore.

19. The valve drive according to claim 1, wherein:

the at least one control shaft further includes a longitudinal groove radially circulating about the at least one control shaft in at least one region; and at least one of the first control element and the second control element is a rotary lever having a circumferential region encasing the at least one control shaft on the longitudinal groove, the rotary lever including a connecting pin projecting through a through-bore disposed in the circumferential region and into the longitudinal groove, the connecting pin tiltably connecting the rotary lever and the at least one control shaft such that the rotary lever adjusts between the switching element position and the basic element position via an adjustment of the connecting pin in the longitudinal groove.

20. An internal combustion engine comprising the valve drive of claim 1.

* * * * *